US006062385A

United States Patent [19]

Cho

[11] Patent Number: 6,062,385

[45] Date of Patent: May 16, 2000

[54] MULTIFUNCTIONAL TOOL BOX

[76] Inventor: Chiung-Hua Cho, P.O. Box 82-144, Taipei, Taiwan

[21] Appl. No.: 09/323,016

[22] Filed: Jun. 1, 1999

[51] Int. Cl.[7] ..... B65D 6/00

[52] U.S. Cl. ..... 206/373; 206/748; 206/216; 220/819; 220/843

[58] Field of Search ..... 206/748, 372, 206/373, 216; 220/819, 826, 843

[56] References Cited

U.S. PATENT DOCUMENTS

| | | | |
|---|---|---|---|
| 2,141,449 | 12/1938 | Rathbun | 220/843 |
| 4,998,616 | 3/1991 | Hillinger | 206/748 |
| 5,423,404 | 6/1995 | Shaw | 190/102 |
| 5,429,235 | 7/1995 | Chen | 206/372 |

*Primary Examiner*—Paul T. Sewell
*Assistant Examiner*—Troy O Arnold, III
*Attorney, Agent, or Firm*—A & J

[57] ABSTRACT

A multifunctional tool box comprising (a) a central container having an article-holding recess on the top surface thereof and a second article-holding recess on the bottom surface thereof, the center of the front edge of the central container being mounted with a pair of male engaging elements, facing each other, the rear edge corners of the central container being provided with a pair of female connection holes, and a handle being pivotally disposed across the male engaging elements; (b) a top and a bottom edge cover individually provided with an article-holding recess, and the center of the front edge thereof being individually provided with an engaging member and the four corners of the top and the bottom edge cover being disposed with a female connection hole, and the center of the rear edge of the top and the bottom edge cover being provided with a male fastener member, (c) a plurality of connection plates having one surface being provided with two perpendicular protrusions to mount the central container with the top edge cover and the bottom edge cover at the connection holes; and (d) a plurality of foamed material sheets mounted within the central container and the interior of the article-holding recess of the top and bottom edge cover for holding and retaining tools, whereby the engaging member at the center of the front edge of the top and bottom edge cover are engaged with the male engaging elements of the central container, and the connection plates are pivotally connected the top and bottom edge cover with the central container, such that the tool box can contain a plurality of tool within the article-holding recess and the tool box can be opened or closed with respect to the connection plates.

1 Claim, 6 Drawing Sheets

MULTIFUNCTIONAL TOOL BOX

BACKGROUND OF THE INVENTION a) Technical Field of the Invention

The present invention relates to a multifunctional tool box, and in particular, to a tool box with variable structure to accommodate a plurality of tools.

b) Description of the Prior Art

Conventional tool box is normally manufactured by plastic molding process and the cavity of the box for keeping tools is fixed and limited. Accordingly, the tool box may be either too big for some users but too small for the other users. That is, the tool box does not have a variable cavity if only a handful of tools are to be kept or required. In addition, the conventional tool box is provided with a plurality of article-holding recesses that cannot be changed. These are the drawbacks found in the recently available tool box.

Therefore, it is the object of the present invention to overcome the above drawbacks by providing a multifunctional tool box with variable article-holding recess. In other words, the structure of the tool box can be changed so as to provide adequate cavity to hold or to keep the required tools.

SUMMARY OF THE INVENTION

An aspect of the present invention is to provide a multifunctional tool box comprising (a) a central container having an article-holding recess on the top surface thereof and a second article-holding recess on the bottom surface thereof, the center of the front edge of the central container being mounted with a pair of male engaging elements, facing each other, the rear edge corners of the central container being provided with a pair of female connection holes, and a handle being pivotally disposed across the male engaging elements; (b) a top and a bottom edge cover individually provided with an article-holding recess, and the center of the front edge thereof being individually provided with an engaging member and the four corners of the top and the bottom edge cover being disposed with a female connection hole, and the center of the rear edge of the top and the bottom edge cover being provided with a male fastener member, (c) a plurality of connection plates having one surface being provided with two perpendicular protrusions to mount the central container with the top edge cover and the bottom edge cover at the connection holes; and (d) a plurality of foamed material sheets mounted within the central container and the interior of the article-holding recess of the top and bottom edge cover for holding and retaining tools, whereby the engaging member at the center of the front edge of the top and bottom edge cover are engaged with the male engaging elements of the central container, and the connection plates are pivotally connected the top and bottom edge cover with the central container, such that the tool box can contain a plurality of tool within the article-holding recess and the tool box can be opened or closed with respect to the connection plates.

Another object of the present invention is to provide a multifunctional tool box, wherein the top and bottom edge cover can be combined together to form a tool box with a smaller article-holding recess capability.

Yet another object of the present invention is to provide a multifunctional tool box, wherein the foamed material sheet is fabricated to have the shapes of the tools so that the user can select the required tool conveniently.

Another object of the present invention is to provide a multifunctional tool box, wherein the combination of the parts of the tool box is simple, without special tool to complete assembling or disassembling of parts.

Other and further objects and features of the present invention will become obvious upon an understanding of the illustrative embodiments about to be described in connection with the accompanying drawings or will be indicated in the appended claims, and various advantages not referred to herein will occur to one skilled in the art upon embodying of the invention in practice.

DETAILED DESCRIPTION OF THE PREFERRED EMBODIMENT

Figure 1:
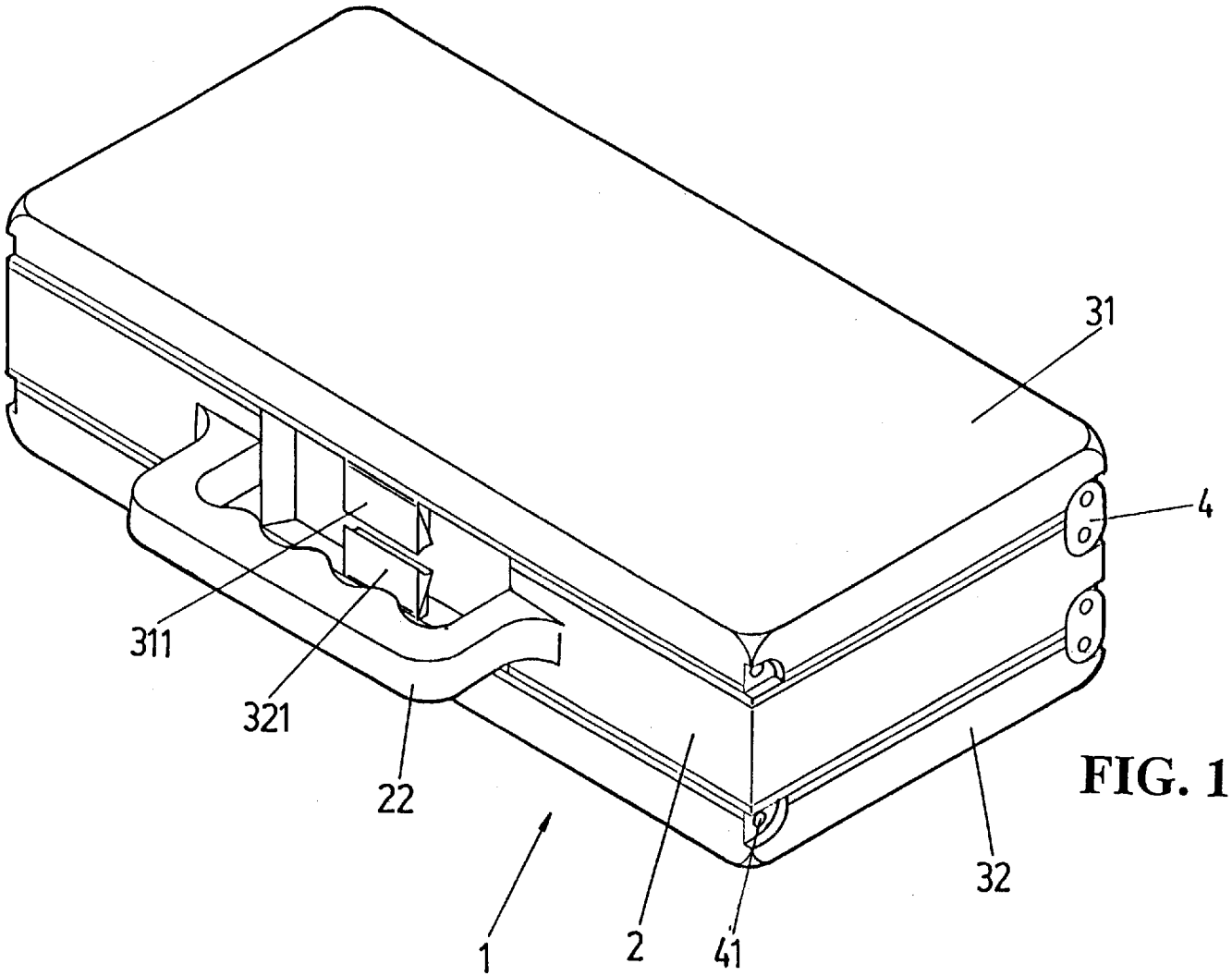
FIG. 1 a perspective view of the tool box in accordance with the present invention.
Figure 2:
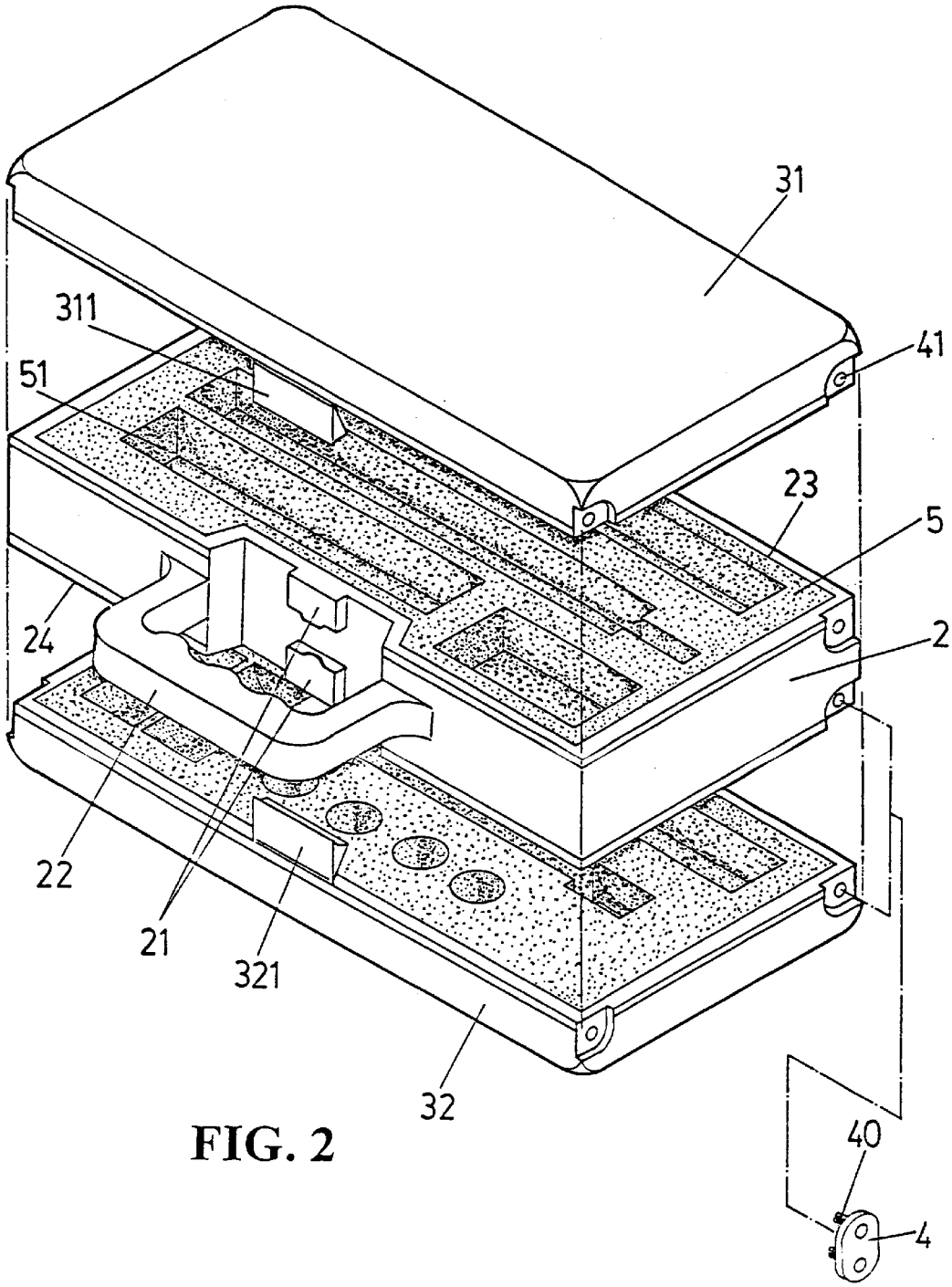
FIG. 2 is a perspective exploded view of the tool box in accordance with the present invention.

The present invention will now be described in more detail with reference to the accompanying drawings:

Referring now to FIGS. 1 and 2, there are shown a perspective view and an exploded perspective view of a multifunctional tool box 1 comprising a central container 2, and a top and a bottom edge cover 31, 32, wherein the top and bottom surface of the central container 2 are provided with a plurality of article-holding recesses 23, 24 for keeping tools (not shown) of varies shapes. At the center of the front edge of the central container 2, a pair of male engaging elements 21, facing each other, as shown in FIG. 2, are provided. At the rear edge corners of the central container 2 a pair of female connection holes 41 are provided. A handle 22 of ergonomic design is pivotally mounted across the male engaging elements 21 for carrying of the box 1. The top edge cover 31 and the bottom edge cover 32 are individually provided with an article-holding recess 312, 322 (refer to FIG. 4) individually having a male fastener members 313, 323 at the center of the rear edge of the top and bottom edge cover 31, 32, opposite to the engaging members 311, 321. The four corners of the top edge cover 31 and the bottom edge cover 32 are provided with a female connection hole 41.

A male connection plate 4 having a pair of perpendicular protrusions 40 is used to pivotally engage with the central container 2 to the top edge cover 31 and another plate 4 is used to connect the central container 2 to the bottom edge cover 32. After that, the engaging members 311, 321 at the front edge of the top and bottom edge cover 31, 32 are then mounted to the male engaging elements 21 at the central container 2. Thus, the multifunctional tool box 1 is obtained.

In accordance with the present invention, the article-holding recesses 23, 24, 312, 322 are then each mounted with a foamed material sheet 5, wherein a plurality of cavities 51 having the shapes of various tools are formed on the foamed material sheet 5. These cavities 51 are used to keep or to hold the tools in place.

Figure 3:
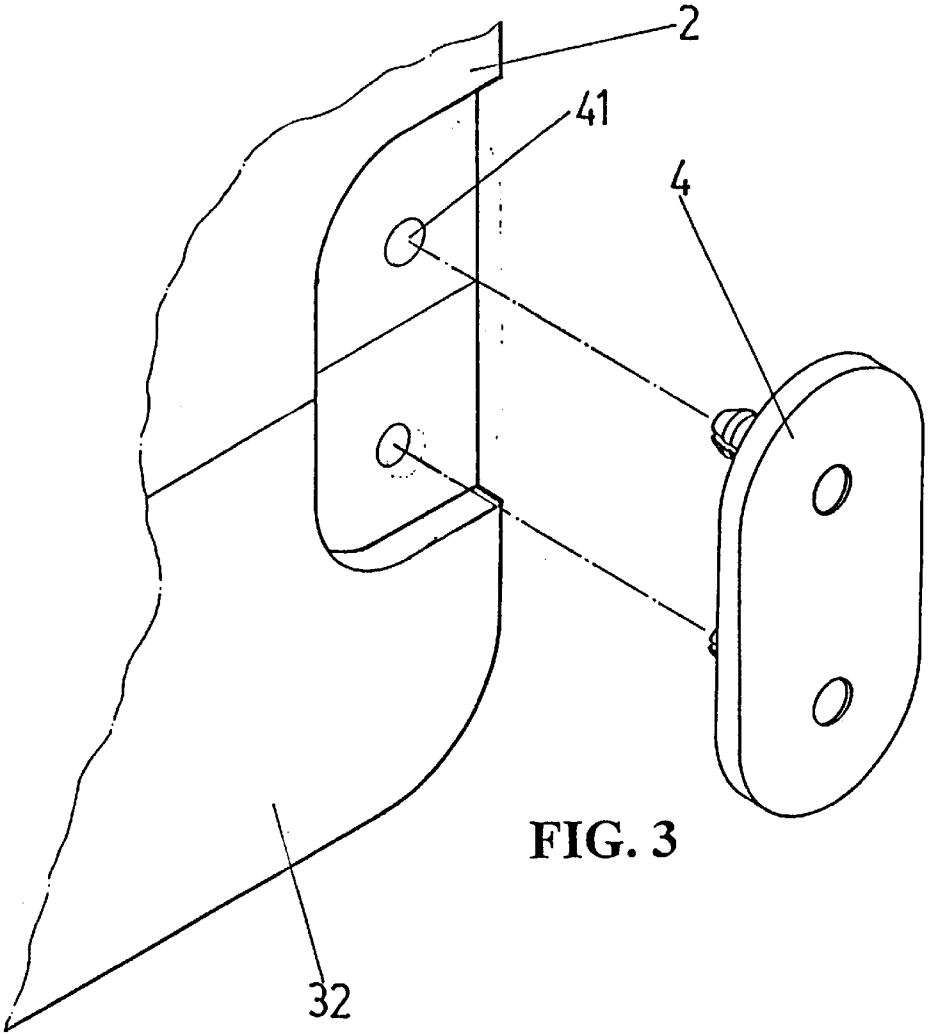
FIG. 3 is a schematic view illustrating the connection plate being mounted to the bottom edge cover together with the central container at the connection hole in accordance with present invention.

FIG. 3 is a schematic view illustrating the fastening of the connection plate 4 with the female connection holes 41. As shown in FIG. 3, the connection plate 4 is an oval shape structure having a pair of perpendicular protrusions 40 on one side of the connection plate 4. The plate 4 connects the central container 2 to the bottom edge plate 32 to form as a unit (tool box).

Figure 4:
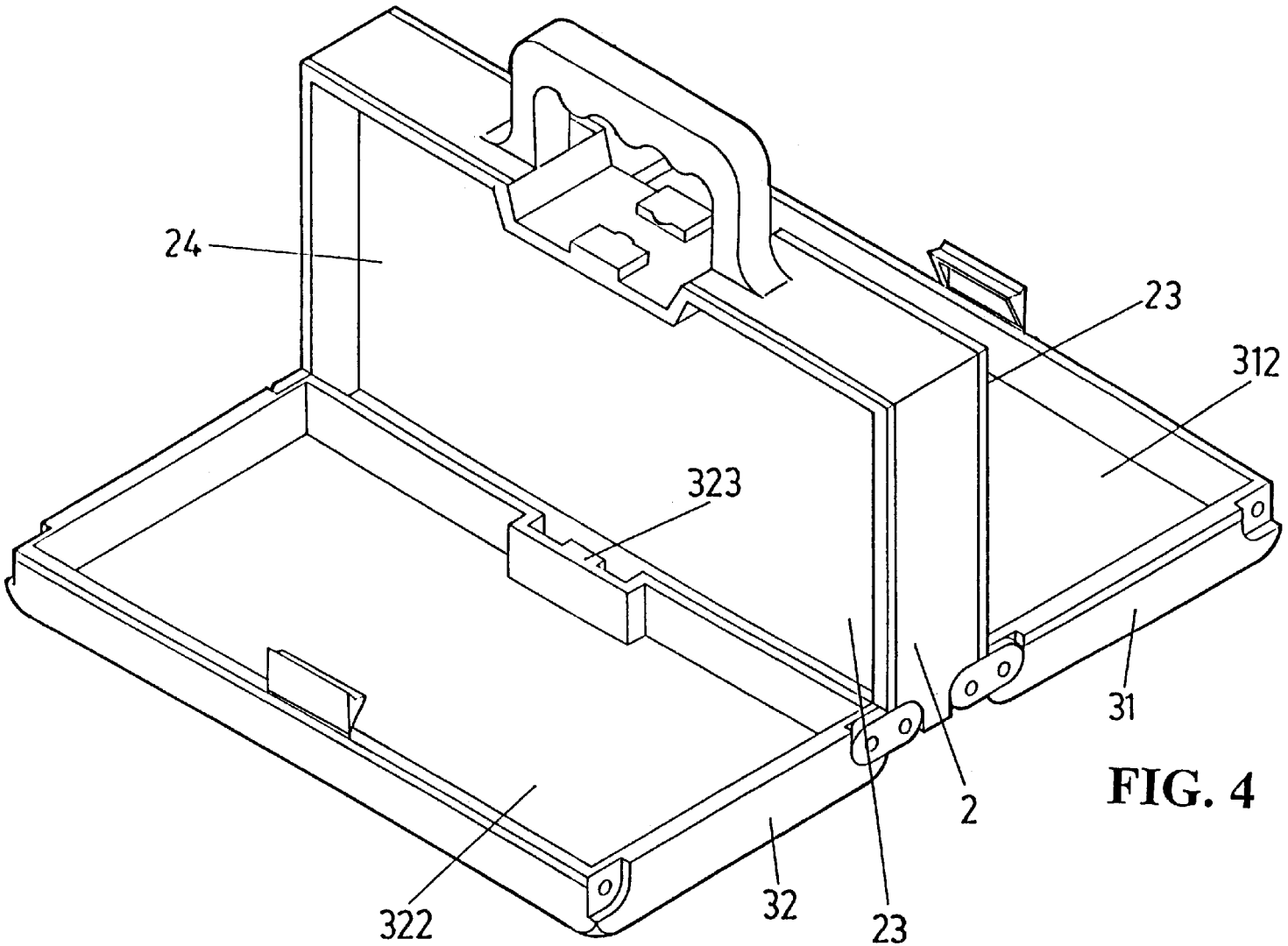
FIG. 4 is a perspective view illustrating the opening of the tool box in accordance with the present invention.

FIG. 4 is a perspective view illustrating the opening of the tool box 1 in accordance with the present invention. When the top edge cover 31 and the bottom edge cover 32 are opened horizontally, in accordance with the present invention, the edge covers 31, 32 can be placed flatly on the floor such that the displayed or the held tools in the recesses 23, 24, 312, 322 can be seen clearly. This will facilitate the user to access to the necessary tool for his application. In other words, this tool box provides a quick selection of tools for the user and returning the tools to respective recesses without losing other tools as a result of human negligence.

Figure 5:
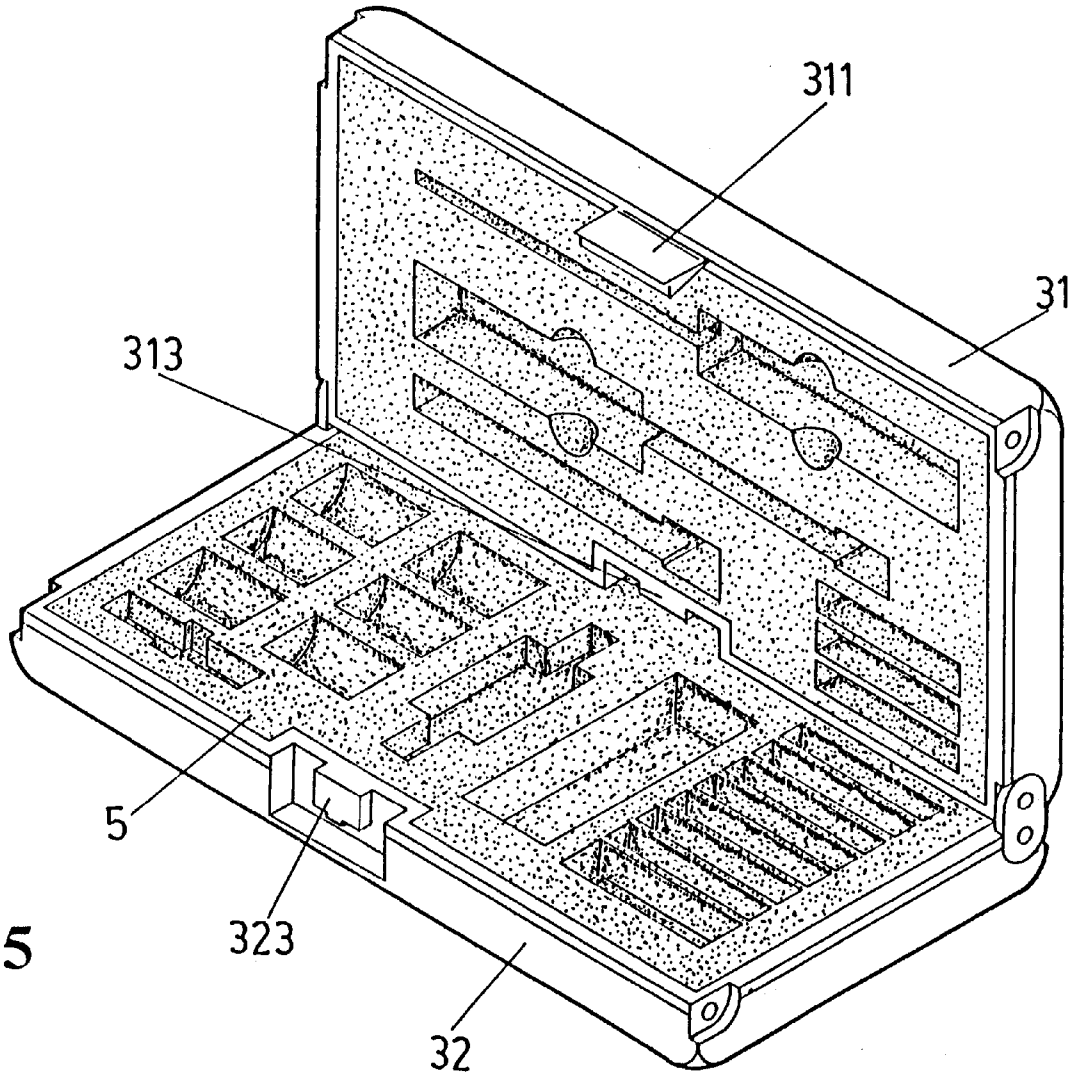
FIG. 5 is a perspective view illustrating the combination of the top edge cover with the bottom edge cover to form another tool box in accordance with the present invention.
Figure 6:
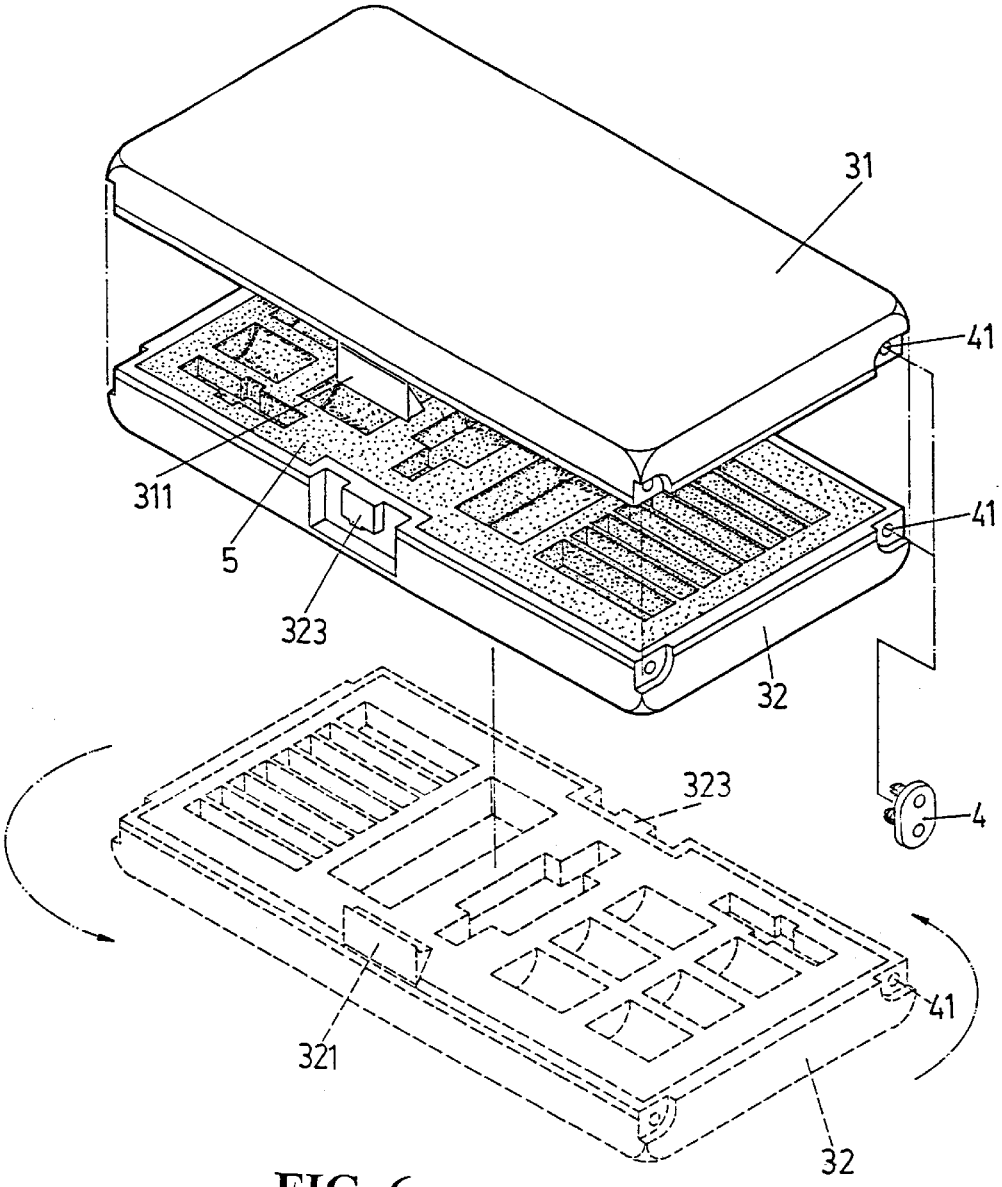
FIG. 6 is a perspective exploded view of the tool box of FIG. 5 in accordance with the present invention.

FIG. 5 is a perspective view illustrating the combination of the top and bottom edge cover of the present invention. FIG. 6 is a perspective exploded view of the multifunctional tool box in accordance with the present invention.

In accordance with the present invention, when the central container 2 is taken out from the combination, one of the two identical top and bottom edge covers 31, 32 is turned such that the rear edge of one edge covers comes into contact with the front edge of the other edge cover.

The male connection plates 4 connect the two top and bottom edge covers 31, 32. At this instance, the engaging member 311 at the center of the front edge cover 31 is engaged with the male fastener member 323 of the bottom edge cover 32 and thus, another tool box is obtained. In accordance with the present invention, the foamed material sheet 5 within the article-holding recesses 312, 322 can be replaced to fit the user application.

Various modifications will become possible for those skilled in the art after receiving the teachings of the present disclosure without departing from the scope thereof.

What is claimed is:

1. A multifunctional tool box comprising:

(a) a central container having an article-holding recess on the top surface thereof and a second article-holding recess on the bottom surface thereof, the center of the front edge of the central container being mounted with a pair of male engaging elements, facing each other, the rear edge corners of the central container being provided with a pair of female connection holes, and a handle being pivotally disposed across the male engaging elements;

(b) a top and a bottom edge cover individually provided with an article-holding recess, and the center of the front edge thereof being individually provided with an engaging member and the four corners of the top and the bottom edge cover being disposed with a female connection hole, and the center of the rear edge of the top and the bottom edge cover being provided with a male fastener member;

(c) a plurality of connection plates having one surface being provided with two perpendicular protrusions to mount the central container with the top edge cover and the bottom edge cover at the connection holes; and (d) a plurality of foamed material sheets mounted within the central container and the interior of the article-holding recess of the top and bottom edge cover for holding and retaining tools, whereby the engaging member at the center of the front edge of the top and bottom edge cover are engaged with the male engaging elements of the central container, and the connection plates are pivotally connected the top and bottom edge cover with the central container, such that the tool box can contain a plurality of tool within the article-holding recess and the tool box can be opened or closed with respect to the connection plates.

* * * * *